US007987800B2

(12) United States Patent
Farber et al.

(10) Patent No.: US 7,987,800 B2
(45) **Date of Patent: *Aug. 2, 2011**

(54) FOLDING TABLE WITH TRANSPORT MECHANISM

(75) Inventors: Robert Farber, Montreal (CA); Jason C. Farber, Montreal (CA)

(73) Assignee: GSC Technologies Corporation, St. Jean, Quebec (CA)

( * ) Notice: Subject to any disclaimer, the term of this patent is extended or adjusted under 35 U.S.C. 154(b) by 100 days.

This patent is subject to a terminal disclaimer.

(21) Appl. No.: 12/542,415

(22) Filed: Aug. 17, 2009

(65) Prior Publication Data

US 2009/0301358 A1 Dec. 10, 2009

Related U.S. Application Data

(63) Continuation of application No. 11/849,101, filed on Aug. 31, 2007, now Pat. No. 7,574,964.

(51) Int. Cl.
*A47B 3/00* (2006.01)

(52) U.S. Cl. ..... 108/115; 108/36; 108/50.17; 190/11; 280/38

(58) Field of Classification Search ..... 108/34, 108/38, 41, 33, 50.17, 43, 167, 166, 132, 108/177, 169, 174, 178, 118, 11, 35, 36; 190/11; 280/30, 38, 32.6, 32.5, 639, 79.11
See application file for complete search history.

(56) References Cited

U.S. PATENT DOCUMENTS

| | | | |
|---|---|---|---|
| 1,072,052 | A | 9/1913 | Stoehr |
| 2,439,660 | A | 4/1948 | Keil |
| 2,472,491 | A | 6/1949 | Quinton |
| 3,118,685 | A | 1/1964 | Jordan |
| 4,471,969 | A | 9/1984 | Zabala et al. |
| 4,779,542 | A | 10/1988 | Staten et al. |
| 5,067,417 | A | 11/1991 | Marmentini et al. |
| 5,092,615 | A | 3/1992 | Gregalis |
| 5,114,118 | A | 5/1992 | Schrader |
| 5,224,531 | A | 7/1993 | Blohm |
| 5,460,391 | A | 10/1995 | Gantz et al. |
| 5,501,157 | A | 3/1996 | Westerburgen |
| 5,540,158 | A | 7/1996 | Ford |

(Continued)

FOREIGN PATENT DOCUMENTS

DE 39 43 398 A1 7/1991

(Continued)

OTHER PUBLICATIONS

European Search Report for Application No. EP 08 15 1737, dated Oct. 2, 2008.

*Primary Examiner* — Jose V Chen
(74) *Attorney, Agent, or Firm* — Husch Blackwell LLP

(57) ABSTRACT

A folding table includes two tabletop halves pivotally joined together at an axle, with one or more legs connected to each half. A transport member, such as a wheel is mounted on the axle. To transform the table from an "in-use" condition to a "transport" condition, the legs are collapsed to seat adjacent to the underside of the associated tabletop half. The tabletop halves are then pivoted toward each other until the undersides are in facing relationship to each other. So pivoting the tabletop halves exposes the transport member, which can be positioned against the ground to roll or slide the table to a different location.

19 Claims, 7 Drawing Sheets

U.S. PATENT DOCUMENTS

| | | | | |
|---|---|---|---|---|
| 5,687,978 | A | 11/1997 | Rhodes et al. | |
| 5,819,671 | A | 10/1998 | Ocampo | |
| 6,032,585 | A | 3/2000 | Pinch | |
| 6,058,853 | A | 5/2000 | Pinch | |
| 6,401,631 | B1 | 6/2002 | Kane et al. | |
| 6,413,033 | B1 | 7/2002 | Monroig, Jr. | |
| 6,422,567 | B1 | 7/2002 | Mastrangelo et al. | |
| 6,536,796 | B1 | 3/2003 | Solomon | |
| 6,698,361 | B2 | 3/2004 | Lung | |
| 6,705,234 | B1 | 3/2004 | Miller et al. | |
| 6,752,091 | B2 | 6/2004 | Glover et al. | |
| 6,871,861 | B2 | 3/2005 | Hernandez, Jr. | |
| 6,883,849 | B2 | 4/2005 | Hebert | |
| 7,055,899 | B2 | 6/2006 | Zhurong et al. | |
| 7,143,702 | B2 | 12/2006 | Stanford | |
| 7,171,911 | B1 | 2/2007 | Rivera, Jr. et al. | |
| 7,574,964 | B2 * | 8/2009 | Farber et al. | 108/115 |
| 2003/0160145 | A1 | 8/2003 | Prior | |

FOREIGN PATENT DOCUMENTS

| | | | |
|---|---|---|---|
| EP | 0 482 757 | A2 | 4/1992 |
| EP | 1 878 358 | A1 | 1/2008 |
| GB | 2 216 073 | A | 10/1989 |

* cited by examiner

FOLDING TABLE WITH TRANSPORT MECHANISM

CROSS REFERENCE TO RELATED APPLICATIONS

This application is a continuation application of U.S. patent application Ser. No. 11/849,101, filed Aug. 31, 2007 now U.S. Pat. No. 7,574,964, which is hereby incorporated by reference herein.

BACKGROUND

This disclosure generally relates to a folding table integrated with a transport mechanism.

Folding tables generally take the form of a horizontal support surface with a plurality of downwardly extending legs or leg assemblies. An advantage of folding tables is that they are movable from an "in-use" condition to a "storage" or "transport" condition, in which condition the legs are collapsible to seat against or near the underside of the horizontal support surface. The support surface may itself be foldable to decrease the size of the table, thereby allowing for improved storage and transport. A number of known folding tables are disclosed in U.S. Pat. No. 6,705,234 to Miller et al.; U.S. Pat. No. 7,143,702 to Stanford; and U.S. Pat. No. 7,171,911 to Rivera, Jr. et al., all of which are hereby incorporated herein by reference.

A general aspect or object of the present invention is to provide a folding table with improved transportability.

Other aspects, objects and advantages of the present invention, including the various features used in various combinations, will be understood from the following description according to illustrative embodiments of the present invention, taken in conjunction with the drawings in which certain specific features are shown.

SUMMARY

According to one aspect of the present invention, a folding table comprises first and second tabletop halves each having an upper surface, inside edge, and an underside. The tabletop halves are pivotally connected together along an axle at or adjacent to the inside edges. A first leg or leg assembly is connected to the first tabletop half and a second leg or leg assembly is connected to the second tabletop half. Each leg is movable between a support condition extending away from the associated tabletop half to engage the ground and a stored condition positioned adjacent to the underside of the associated tabletop half. The table also includes at least one transport member mounted on the axle. The tabletop halves are pivotal toward each other about the axle to place their undersides in facing relationship to each other when the legs are in the stored condition. When the tabletop halves are so pivoted, the transport member is exposed between the inside edges of the tabletop halves for engagement with the ground for transport of the folding table.

According to another aspect of the present invention, a folding table comprising first and second tabletop halves each having an upper surface, an inside edge, and an underside. The tabletop halves are pivotally connected together along an axle at or adjacent to the inside edges. A first leg or leg assembly is connected to the first tabletop half and a second leg or leg assembly connected to the second tabletop half. The table also includes at least one transport member mounted on the axle. The folding table is movable between an in-use condition and a transport condition. In the in-use condition, each leg extends away from the associated tabletop half to engage the ground, the inside edges of the tabletop halves engage each other to provide a substantially horizontal support surface, and the transport member is supported adjacent to and below the inside edges of the tabletop halves. In the transport condition, each leg is positioned adjacent to the underside of the associated tabletop half, the undersides of the tabletop halves are in facing relationship to each other, the inside edges of the tabletop halves are spaced from each other, and the transport member is exposed between the inside edges of the tabletop halves for engagement with the ground for transport of the folding table.

According to yet another aspect of the present invention, a method of collapsing and transporting a folding table comprises collapsing legs of the folding table to be adjacent to an underside of a tabletop of the folding table. The tabletop is folded along a pivotal axle thereof to place a portion of the underside of the tabletop in facing relationship to another portion of the underside of the tabletop, thereby exposing a transport member mounted on the axle. The transport member is then positioned against the ground and the table is moved along the ground while the transport member is in engagement with the ground.

DESCRIPTION OF THE ILLUSTRATED EMBODIMENTS

Although the present invention is described as illustrated in the attached drawings of one possible embodiment, it is to be understood that the illustrated embodiment is merely exemplary of the invention, which may be embodied in various forms. Therefore, specific details disclosed herein are not to be interpreted as limiting, but as a representative basis for teaching one skilled in the art to variously employ the present invention in virtually any appropriate manner.

Figure 1:
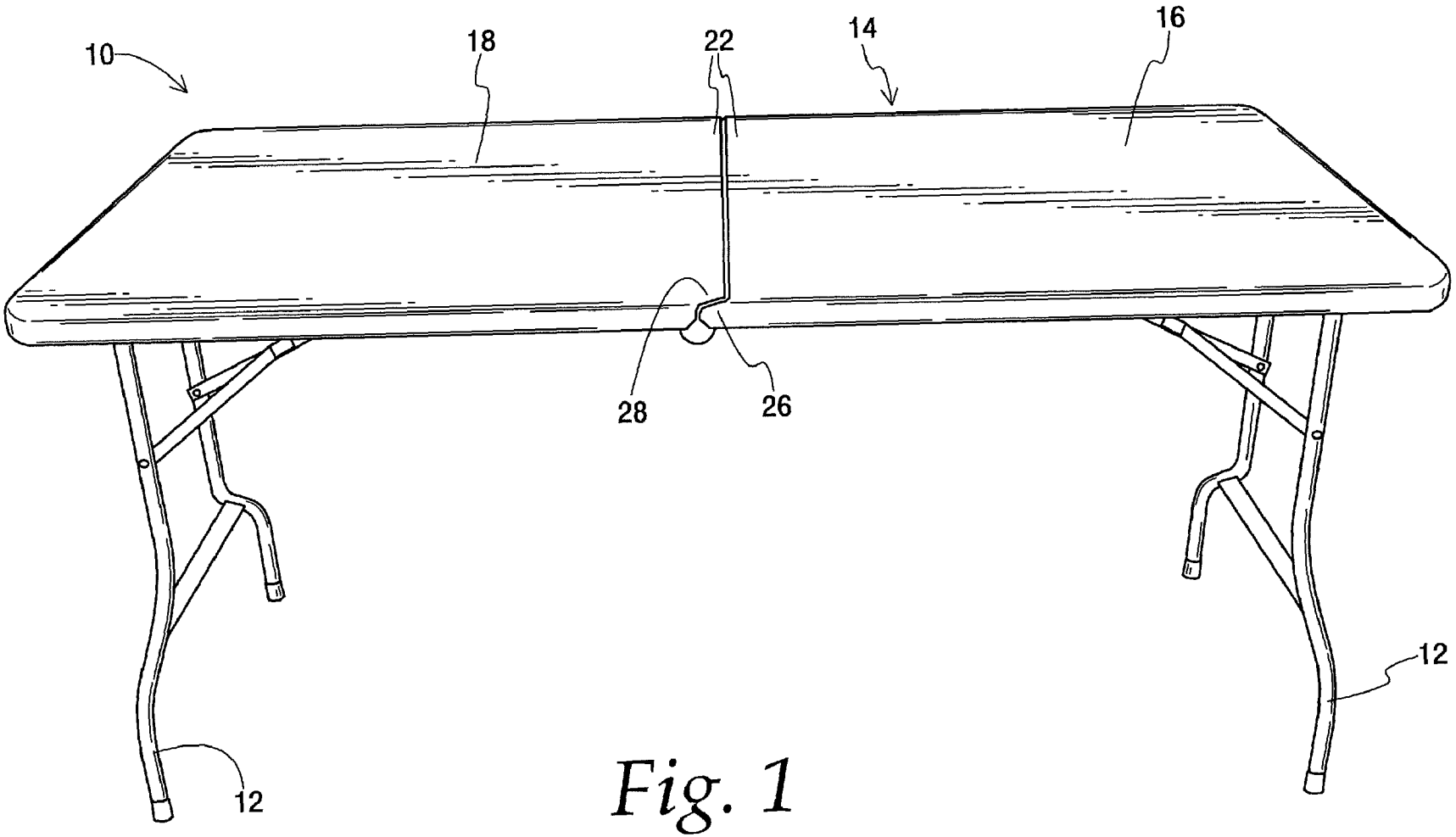
FIG. 1 is a perspective view of a folding table according to an aspect of the present invention.

FIG. 1 shows a folding table 10 in an "in-use" condition, wherein two or more legs 12 extend away from an underside of a substantially planar, horizontal support or tabletop 14 to engage the ground and support the tabletop 14. The term "legs" is used herein and contemplates leg assemblies and leg members.

Figure 2:
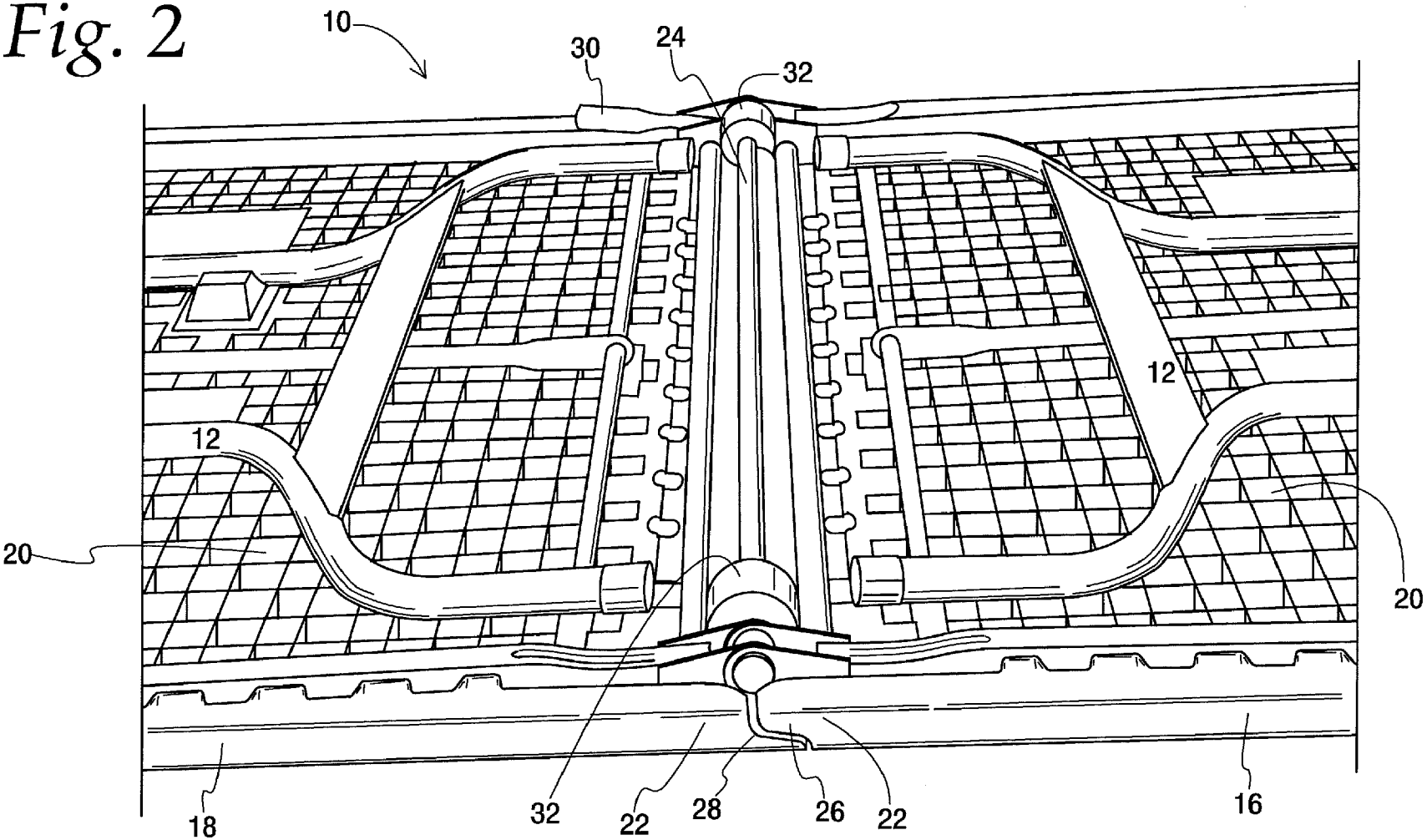
FIG. 2 is a perspective view of the underside of the folding table of FIG. 1, in a partially collapsed condition.
Figure 3:
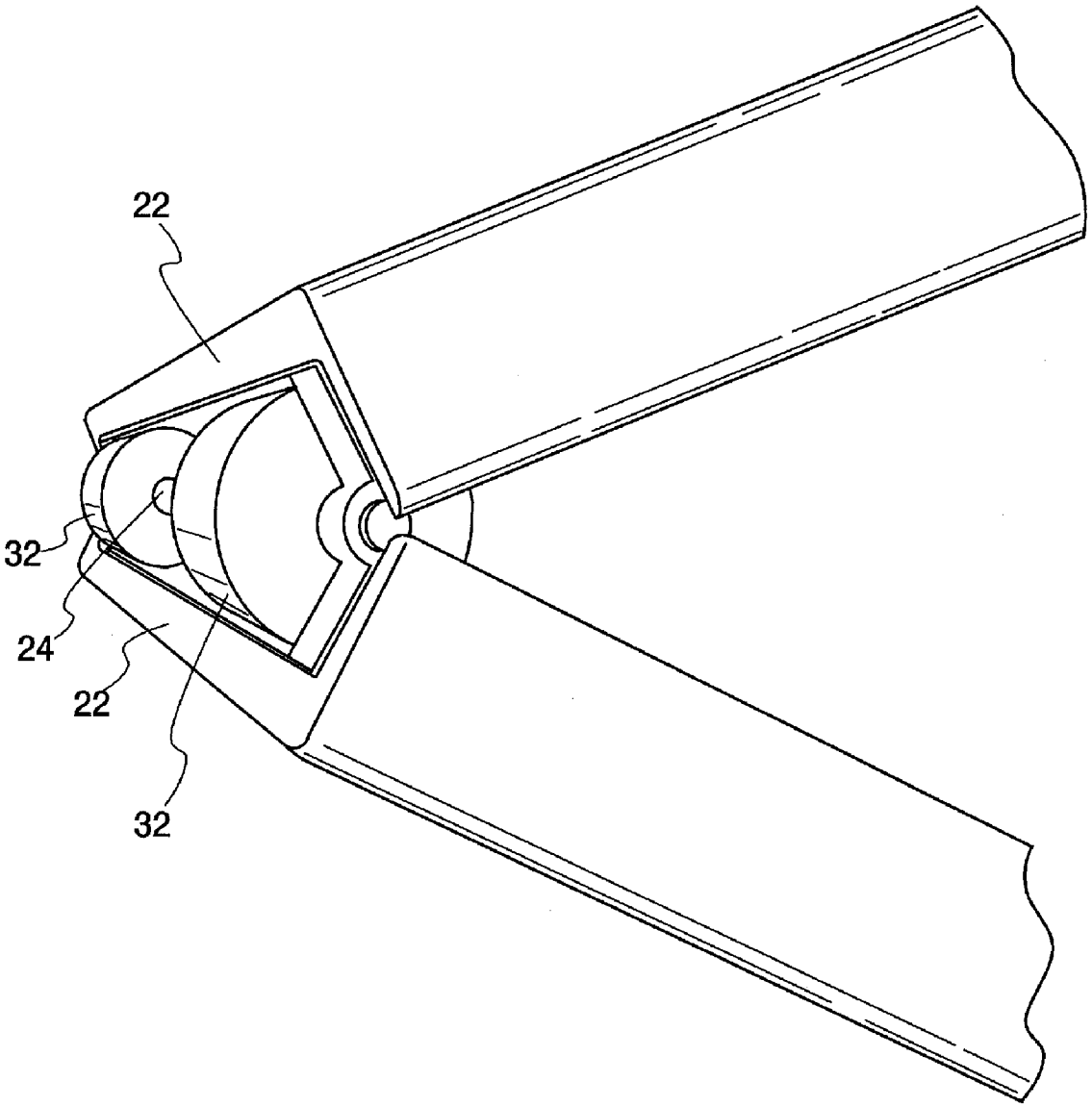
FIG. 3 is a detail view of inside edges of the tabletop halves of another embodiment of a folding table according to an aspect of the present invention.

The tabletop 14 is comprised of a first half 16 and a second half 18. Each half has an underside 20 (FIG. 2) and an inside edge 22. The tabletop halves 16 and 18 are pivotally connected to each other at or adjacent to their inside edges 22 along a shaft or axle 24, as shown in FIG. 2. In the "in-use" condition of FIG. 1, the halves 16 and 18 have been pivoted away from each other until the inside edges 22 engage each other and their undersides 20 face generally downwardly. In the illustrated embodiment, the inside edge of the first half 16 includes an undercut 26 adapted to conform to an overhang 28 of the second half 18 when the table 10 is in the "in-use" condition. Other inside edge configurations, such as substantially identical edges (FIG. 3) adapted to abut end-to-end with each other in the "in-use" condition, may also be employed without departing from the scope of the present disclosure. The table 10 may also include a locking lever 30 (FIGS. 2 and 4) or similar locking mechanism to prevent the halves from inadvertently pivoting toward each other, thereby maintaining the table 10 in the "in-use" condition.

Figure 4:
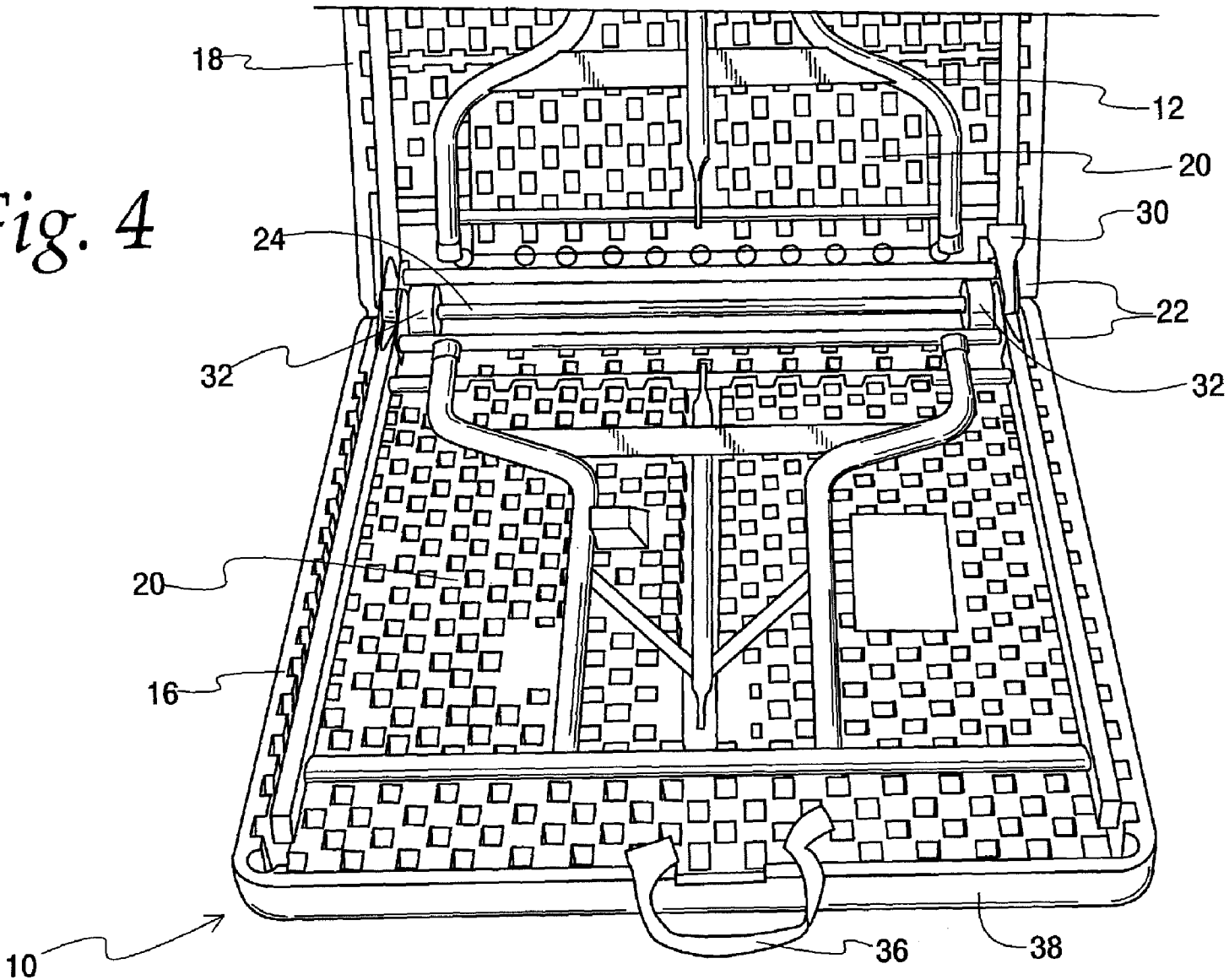
FIG. 4 is another view of the folding table of FIG. 1 in a partially collapsed condition.

FIGS. 2 and 4 show the table 10 in a partially collapsed condition. In the illustrated condition, the tabletop halves 16 and 18 are at least partially pivoted away from each other and the legs 12 are folded or collapsed to seat against the underside 20 of the associated tabletop half. Each leg 12 is confined to one half of the tabletop and does not cross beyond the axle 24, thereby allowing the halves 16 and 18 to be pivoted toward each other to a "transport" condition (FIGS. 5 and 6) that will be described in greater detail herein. A number of mechanisms by which the legs 12 may be collapsed to seat against the underside 20 of the tabletop 14 are known to those of ordinary skill in the art, any of which mechanisms may be employed without departing from the scope and spirit of the present disclosure.

There is at least one transport member 32 associated with the axle 24, but preferably, two transport members 32 are mounted on the axle 24, as shown in FIG. 2. Those of ordinary skill in the art will appreciate that more than two transport members may also be spaced along the axle. As will be described in greater detail, the transport members 32 are positioned to engage the ground when the table 10 is in a "transport" condition (FIGS. 5 and 6), so they may be provided for rolling or sliding engagement with the ground. In the illustrated embodiment, the transport members 32 are wheels suitable for rolling engagement with the ground.

The wheels 32 of FIG. 2 have a larger diameter than the axle 24, so one or both of the inside edges 22 may be provided with a channel 34 (FIG. 5) in which one of the wheels 32 is at least partially received. Hence, it will be seen that the transport members 32 are at least partially received by the tabletop 14 itself, which may be advantageous in shielding the transport member 32 from contact with a user when the table 10 is in the "in-use" condition of FIG. 1.

Figure 5:
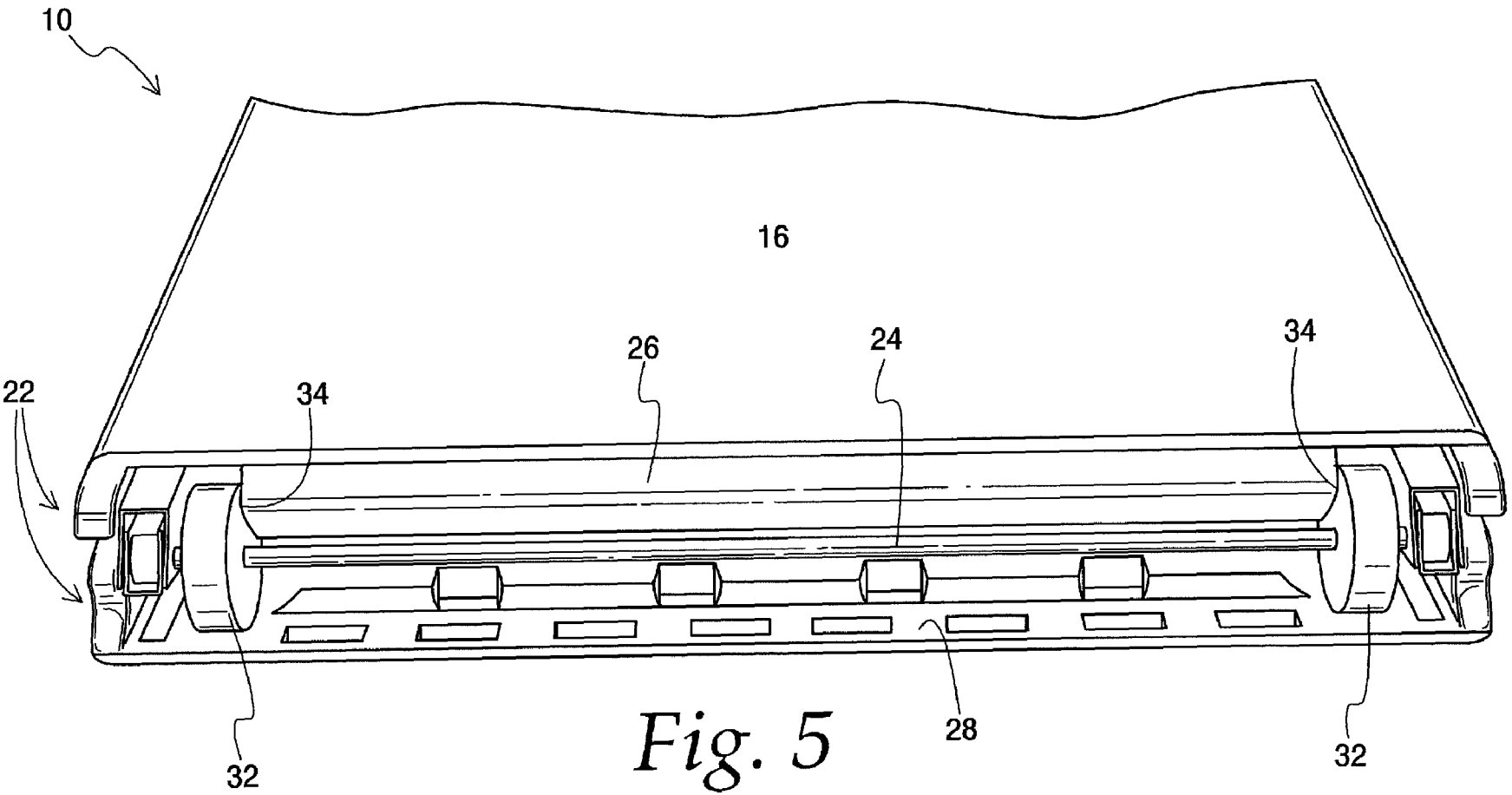
FIG. 5 is an end view of the folding table of FIG. 1 in a "transport" condition.

The channel 34 is more visible in FIG. 5, which shows the table 10 in a "transport" condition. When the table 10 is in the "transport" condition (FIGS. 5 and 6), each leg 12 remains positioned adjacent to the underside 20 of the associated tabletop half and the tabletop halves 16 and 18 have been fully pivoted toward each other, with the undersides 20 in facing relationship and the inside edges 22 being spaced away from each other to expose the transport member 32. If the table is provided with a locking lever 30 or similar locking mechanism, it typically will be disengaged by a user before the tabletop halves 16 and 18 can be pivoted toward each other.

To move the table 10 in the "transport" condition, the transport members 32 are positioned against the ground and the table 10 is pushed, pulled, or slid by a user. In the illustrated embodiment, the transport members 32 are sized to extend at least slightly beyond the inside edges 22, which may be advantageous to prevent the inside edges 22 from contacting the ground during transport and becoming damaged.

Figure 6:
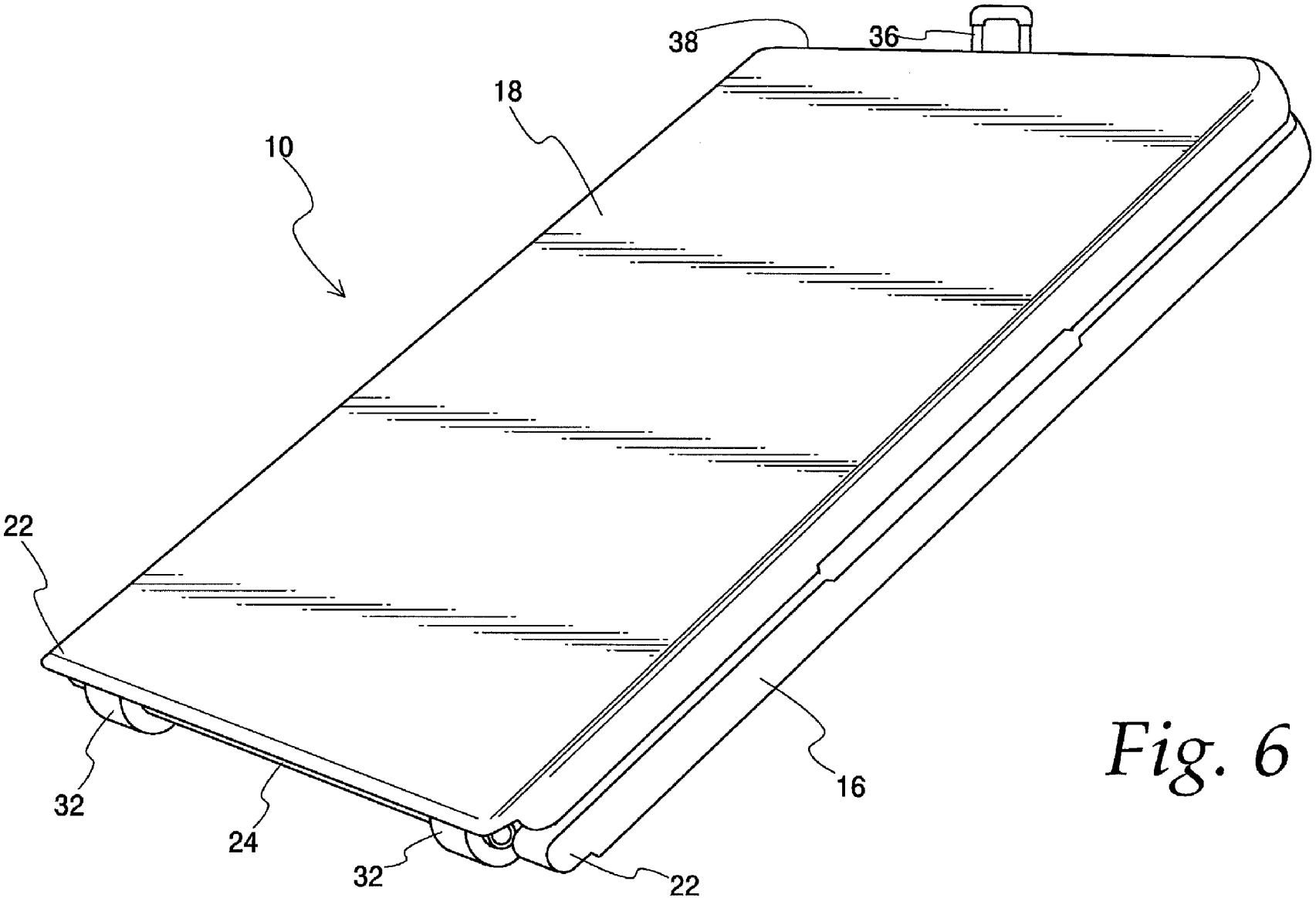
FIG. 6 is a perspective view of the folding table of FIG. 1 in a "transport" condition.
Figure 7:
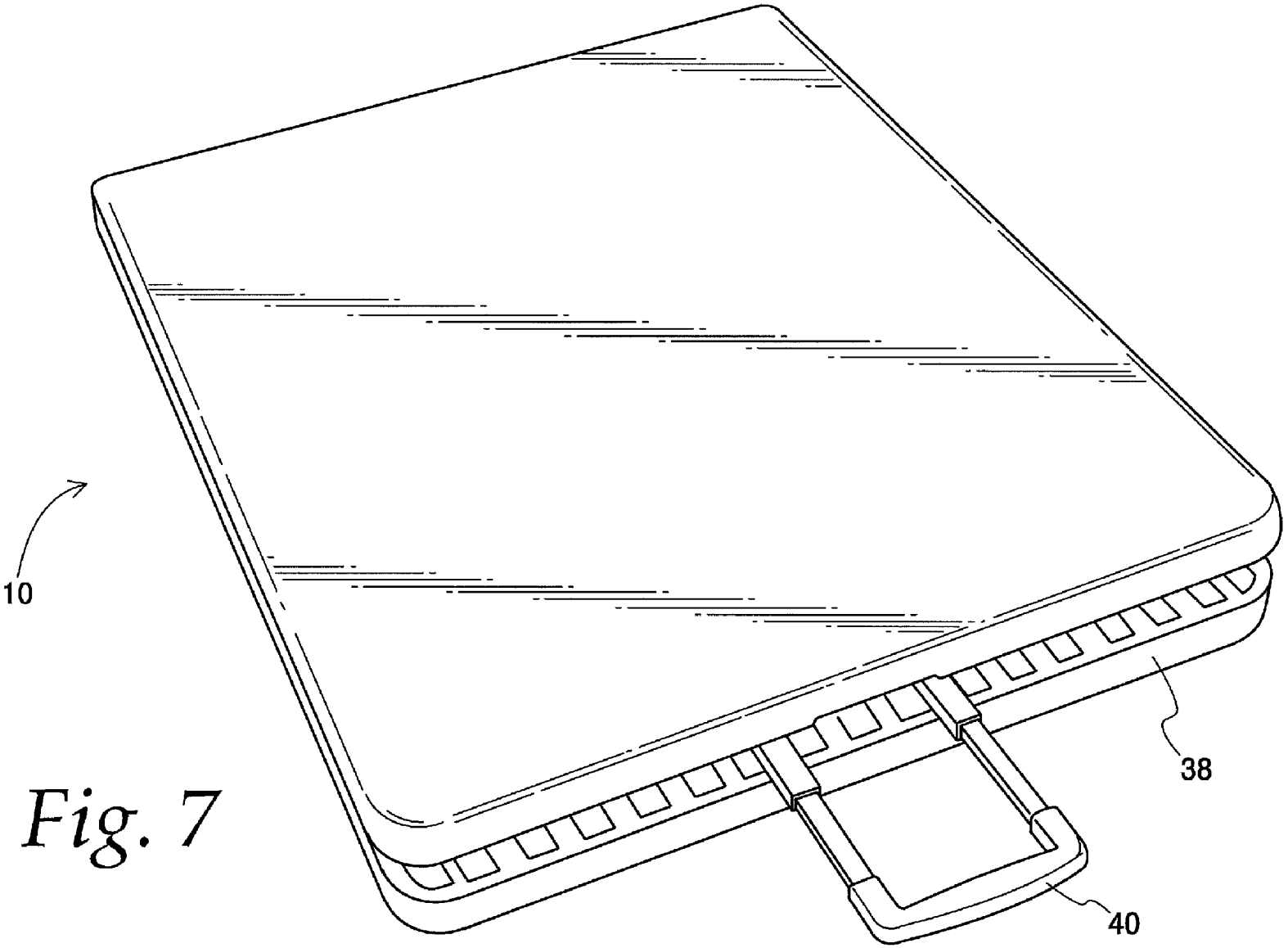
FIG. 7 is a perspective view of another embodiment of a folding table according to an aspect of the present invention, in a "transport" condition.

As shown in FIGS. 4 and 6, one or both of the tabletop halves may be provided with a handle 36 for transporting the table 10. In one embodiment, the handle 36 is at or adjacent to one of the outside edges 38 of the tabletop 10 (i.e., the edge opposite the inside edge of the associated tabletop half). By such a configuration, a user may grip the handle 36 and pull the table 10 along the ground while the transport members 32 slide or roll along the ground (FIG. 6). In the embodiment of FIGS. 4 and 6, the handle 36 is a strap comprised of a flexible material such as, but not limited to, nylon. Other handles, such as a telescoping handle 40 (FIG. 7), may also be employed without departing from the scope of the present disclosure.

Tables according to the present disclosure may be constructed of any known, sturdy materials, but in one embodiment, the transport member and tabletop halves are comprised of a plastic material, while the legs and axle are comprised of a metal material.

An improved method of collapsing and transporting a folding table is also made possible by tables according to the present disclosure. The legs of the table are collapsed to be adjacent to an underside of a tabletop of the folding table. The tabletop itself is then folded along the axle to place the undersides of the tabletop halves in facing relationship to each other, thereby exposing the transport member or members mounted on the axle. The table is then arranged to position the transport member or members against the ground, and then the table is moved while the transport member is in engagement with the ground.

The tabletop is preferably a blow-molded structure of the type customarily used over the past several years in the United States (and other) market for so-called "utility tables" and the like. The underside of the blow molded plastic tabletop or tabletop halves will have a pattern of what are sometimes called "kiss-offs" which strengthen the structure. Typically, some structure on the underside of the tabletop extends downward to engage and secure the leg when it is folded into the storage position. This can be a detent mechanism or any friction-applying structure. The tabletop halves may be generally symmetric and have generally vertical sides that come together in the center of the table in the "use" position and are generally parallel in the stored position. However, such a "butt joint" structure is not required, and alternatives may be used where, for example, the sidewall structures (in the middle of the table) of the two halves are complementary instead of generally identical. Hence, a lip could be provided on one half so that when the table is opened into the "use" position, the lip on one half overlaps part of the second half. The lip may be at the tabletop upper surface or its lower surface. Other configurations may be chosen. The wheels may be made of plastic (as mentioned), metal, rubber, a synthetic, or another natural substance, or any combination thereof. The size may be selected as appropriate to the size of the table. The wheel diameters may be, for example, in the range of one inch to several inches, e.g. four or five inches. A nominal wheel diameter may be between 1.5 and 3 inches. The axle may be continuous or sectioned. It may be metallic or made of a synthetic or composite. Other variations within the scope and spirit of this invention will occur to the skilled artisan in light of this disclosure.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein. For these reasons, the scope of the invention is not limited to the above description but is as set forth in the following claims.

The invention claimed is:

1. A folding table comprising:

a first tabletop portion having an inside edge and an underside;

a second tabletop portion having an inside edge and an underside, wherein the tabletop portions are pivotally connected together along an axle at or adjacent to the inside edges and the inside edges of the tabletop portions are substantially identical;

a first leg connected to the first tabletop portion;

a second leg connected to the second tabletop portion; and at least one rotatable wheel mounted on the axle, wherein the tabletop portions are pivotally movable between (a) an in-use condition in which each leg extends away from the associated tabletop portion to engage a surface, the inside edges of the tabletop portions engage each other to provide a substantially horizontal support surface, and the wheel is positioned adjacent to and below at least one of the inside edges of the tabletop portions, and (b) a transport condition in which each leg is positioned adjacent to the underside of the associated tabletop portion, the undersides of the tabletop portions are in facing relationship to each other, the inside edges of the tabletop portions are spaced from each other, and the wheel is at least partially exposed between the inside edges of the tabletop portions for rolling engagement with a surface for transport of the folding table.

2. The folding table of claim 1, further comprising an additional rotatable wheel mounted on the axle.

3. The folding table of claim 1, further comprising a handle associated with at least one of the tabletop portions at or adjacent to an outside edge of the associated tabletop portion.

4. The folding table of claim 1, wherein at least one of the inside edges includes a channel and the wheel is at least partially received within the channel in the in-use condition.

5. The folding table of claim 1, wherein at least one of the inside edges includes a channel and the wheel is at least partially received within the channel in the transport condition.

6. The folding table of claim 1, wherein at least one of the inside edges includes a channel and the wheel is at least partially received within the channel in the in-use and transport conditions.

7. The folding table of claim 1, wherein the wheel extends beyond both of the inside edges of the tabletop portions in the transport condition.

8. The folding table of claim 1, further comprising a pair of bearings fixedly secured at or adjacent to the inside edges of the tabletop portions, wherein the axle extends between the bearings and is journaled in the bearings.

9. A folding table comprising:

a first tabletop portion having an inside edge and an underside;

a second tabletop portion having an inside edge and an underside, wherein the tabletop portions are pivotally connected together along an axle at or adjacent to the inside edges and the inside edges of the tabletop portions are non-identical and complementary;

a first leg connected to the first tabletop portion;

a second leg connected to the second tabletop portion; and at least one rotatable wheel mounted on the axle, wherein the tabletop portions are pivotally movable between (a) an in-use condition in which each leg extends away from the associated tabletop portion to engage a surface, the inside edges of the tabletop portions engage each other to provide a substantially horizontal support surface, and the wheel is positioned adjacent to and below at least one of the inside edges of the tabletop portions, and (b) a transport condition in which each leg is positioned adjacent to the underside of the associated tabletop portion, the undersides of the tabletop portions are in facing relationship to each other, the inside edges of the tabletop portions are spaced from each other, and the wheel is at least partially exposed between the inside edges of the tabletop portions for rolling engagement with a surface for transport of the folding table.

10. The folding table of claim 9, further comprising an additional rotatable wheel mounted on the axle.

11. The folding table of claim 9, further comprising a handle associated with at least one of the tabletop portions at or adjacent to an outside edge of the associated tabletop portions.

12. The folding table of claim 9, wherein at least one of the inside edges includes a channel and the wheel is at least partially received within the channel in the in-use condition.

13. The folding table of claim 9, wherein at least one of the inside edges includes a channel and the wheel is at least partially received within the channel in the transport condition.

14. The folding table of claim 9, wherein at least one of the inside edges includes a channel and the wheel is at least partially received within the channel in the in-use and transport conditions.

15. The folding table of claim 9, wherein the wheel extends beyond only one of the inside edges of the tabletop portions in the transport condition.

16. The folding table of claim 9, further comprising a pair of bearings fixedly secured at or adjacent to the inside edges of the tabletop portions, wherein the axle extends between the bearings and is journaled in the bearings.

17. The folding table of claim 9, wherein the inside edge of the first tabletop portion has an undercut longitudinally receding away from the axle and the inside edge of the second tabletop portion having an overhang longitudinally extending beyond the axle the undercut adapted to receive the overhang in the in-use condition.

18. The folding table of claim 9, wherein the inside edge of the first tabletop portion comprises an undercut longitudinally receding away from the axle and the inside edge of the second tabletop portion having an overhand longitudinally extending beyond the axle, the overhang positioned distal the axle relative the undercut in the in-use condition.

19. The folding table of claim 9, wherein the inside edge of the first tabletop portion comprises an undercut longitudinally receding away from the axle and the inside edge of the second tabletop portion having an overhand longitudinally extending beyond the axle, the overhang positioned proximal the axle relative the undercut in the in-use condition.

* * * * *